US008720334B2

(12) United States Patent
Kusaka

(10) Patent No.: US 8,720,334 B2
(45) Date of Patent: May 13, 2014

(54) SHEET-FED PRINTING PRESS

(75) Inventor: Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 786 days.

(21) Appl. No.: 11/762,513

(22) Filed: Jun. 13, 2007

(65) Prior Publication Data

US 2007/0289463 A1 Dec. 20, 2007

(30) Foreign Application Priority Data

Jun. 15, 2006 (JP) ..... 2006-165540

(51) Int. Cl.
*B41F 5/02* (2006.01)

(52) U.S. Cl.
USPC ..... 101/230; 101/222

(58) Field of Classification Search
USPC ..... 101/220, 231, 232, 229
See application file for complete search history.

(56) References Cited

U.S. PATENT DOCUMENTS

| | | | | |
|---|---|---|---|---|
| 4,188,883 | A * | 2/1980 | Schone et al. | 101/183 |
| 4,732,084 | A | 3/1988 | Wirz | |
| 4,794,856 | A | 1/1989 | Giori | |
| 4,856,426 | A * | 8/1989 | Wirz | 101/217 |
| 5,042,378 | A | 8/1991 | Germann | |
| 5,671,671 | A | 9/1997 | Wyssmann et al. | |
| 6,338,299 | B1 * | 1/2002 | Kamoda et al. | 101/424.1 |
| 6,675,707 | B1 * | 1/2004 | Heiler et al. | 101/216 |
| 6,718,908 | B1 * | 4/2004 | Bayer et al. | 118/46 |
| 6,722,276 | B1 | 4/2004 | Helmstadter | |
| 2002/0002916 | A1 * | 1/2002 | Sugiyama | 101/142 |
| 2002/0088356 | A1 | 7/2002 | Van Den Brink et al. | |
| 2003/0010233 | A1 | 1/2003 | Schaede | |
| 2003/0104138 | A1 * | 6/2003 | Frazzitta et al. | 427/428 |

FOREIGN PATENT DOCUMENTS

| | | | |
|---|---|---|---|
| DE | 42 19 116 | A1 | 12/1993 |
| DE | 101 38 855 | C1 | 2/2003 |
| EP | 0 132 857 | A1 | 5/1984 |
| EP | 0 158 129 | A2 | 10/1985 |
| EP | 0 664 212 | A1 | 7/1995 |
| EP | 0 723 864 | A1 | 7/1996 |
| EP | 0 819 521 | A2 | 1/1998 |
| EP | 1 092 537 | A2 | 4/2001 |
| EP | 1 125 733 | A1 | 8/2001 |

(Continued)

OTHER PUBLICATIONS

"Technology handbook on printing medium", Nov. 30, 2004, pp. 150-154, 228-238 and 246-249.

(Continued)

*Primary Examiner* — David Banh
(74) *Attorney, Agent, or Firm* — Birch, Stewart, Kolasch & Birch, LLP

(57) ABSTRACT

A sheet-fed printing press comprises: a screen printing unit for printing one surface of a sheet being transported; a drying unit, provided downstream of the screen printing unit in a transport direction, for drying the screen-printed one surface of the sheet; a gravure printing unit, provided downstream of the drying unit in the transport direction, for performing printing on the dried sheet; and a reversing unit, provided between the drying unit and the gravure printing unit, for switching between double-sided printing in which the other surface on the side opposite to the screen-printed one surface of the sheet is gravure-printed, and single-sided printing in which the screen-printed sheet is reversed, and the one surface of the reversed sheet is gravure-printed.

11 Claims, 2 Drawing Sheets

(56) References Cited

FOREIGN PATENT DOCUMENTS

| | | | |
|---|---|---|---|
| EP | 1 153 745 | A1 | 11/2001 |
| EP | 1 574 336 | A1 | 9/2005 |
| EP | 1 867 477 | B1 | 7/2012 |
| FR | 2 046 266 | | 3/1971 |
| GB | 1 304 592 | | 1/1973 |
| GB | 2 106 836 | | 4/1983 |
| JP | 58-126159 | A | 7/1983 |
| JP | 60-42044 | A | 3/1985 |
| JP | 1-37272 | B2 | 8/1989 |
| JP | 02-072952 | A | 3/1990 |
| JP | 2001-225441 | A | 8/2001 |
| JP | 2003-145713 | A | 5/2003 |
| JP | 2004-034641 | A | 2/2004 |
| WO | WO 2007/119167 | A2 | 10/2007 |

OTHER PUBLICATIONS

Japanese Office Action issued in Japanese Patent Application No. 2006-165540 on Jan. 31, 2012.

European Patent Office Communication and Opposition documents issued in European Patent Application No. 07108717.5 on Apr. 15, 2013.

Kipphan, "Handbook of Print Media Technologies and Production Methods", Jul. 31, 2001.

* cited by examiner

SHEET-FED PRINTING PRESS

BACKGROUND OF THE INVENTION

1. Field of the Invention

This invention relates to a sheet-fed printing press which can perform single-sided printing and double-sided printing in one pass when printing a sheet by intaglio printing and stencil printing.

2. Description of the Related Art

Printing presses involve various mechanisms, and they are classified by items, such as a printing process, the form of the sheet, the method of applying pressure, and the method of transfer. Of these items, the printing process is classified by the shape of a plate for doing printing (a printing plate), and includes the following four processes: relief printing, lithographic printing, intaglio printing, and stencil printing.

Of these printing processes, intaglio printing using an intaglio plate is classified into engraved intaglio printing for printing valuables such as bills, stock certificates, and stamps, and gravure printing for printing front is pieces of magazines and a complete series of artworks, and further enabling even synthetic films, building materials, etc. to be printed (see, for example, Japanese Patent Publication No. 1989-37272). These types of intaglio printing are put to a wide variety of uses. Stencil printing using a stencil includes mimeographing and screen printing (see, for example, Japanese Unexamined Patent Publication No. 2001-225441). Stencil printing can use many types of liquids, such as inks and varnishes, and can form thick deposited layers of inks and varnishes on materials to be printed on. Thus, stencil printing permits printing on various forms of materials to be printed on.

If intaglio printing and stencil printing are performed on one surface of a sheet, or on both of one surface and the other surface of the sheet, however, it has been necessary, for example, to perform printing using an intaglio printing press, and then perform printing using a stencil printing press. Thus, a space for installation of the machines and a place for storage of sheet need to be ensured, and much time and effort are required for relocation and registration of the sheet. As a result, the operating efficiency decreases.

Moreover, intaglio printing involves an ink transfer method in which only one surface of the sheet being transported is printed. On the other hand, stencil printing uses an ink transfer method in which only the other surface of the sheet being transported, i.e., the surface on the side opposite to the one surface, is printed. That is, if an intaglio printing press and a stencil printing press are coupled via a transfer cylinder or the like, it is possible to perform intaglio printing on one surface of a sheet, and also perform stencil printing on the other surface of the sheet. However, the problem is posed that it is not possible to perform both of intaglio printing and stencil printing on one surface of a sheet.

The present invention has been accomplished as a solution to the above-described problems. The present invention provides a sheet-fed printing press which can print one surface of a sheet (single-sided printing) and/or both of the one surface and the other surface of the sheet (double-sided printing) in one pass when performing printing on the sheet by intaglio printing and stencil printing.

SUMMARY OF THE INVENTION

A first aspect of the present invention is directed to a sheet-fed printing press, comprising:

a first printing unit for printing one surface of a sheet being transported;

a drying device, provided downstream of the first printing unit in a sheet transport direction, for drying the one surface of the sheet printed by the first printing unit;

a second printing unit, provided downstream of the drying device in the sheet transport direction, for performing printing on the sheet dried by the drying device; and a reversing device, provided between the drying device and the second printing unit, for switching between double-sided printing in which another surface of the sheet on a side opposite to the one surface of the sheet printed by the first printing unit is printed by the second printing unit, and single-sided printing in which the sheet printed on by the first printing unit is reversed, and the one surface of the reversed sheet is printed by the second printing unit, and wherein the first printing unit is one of a stencil printing unit and an intaglio printing unit, and the second printing unit is the other of the stencil printing unit and the intaglio printing unit.

A second aspect of the present invention is directed to the sheet-fed printing press according to the first aspect, wherein the stencil printing unit comprises an impression cylinder for transporting the sheet, and a stencil printing cylinder, provided above the impression cylinder, for performing printing on the sheet being transported, and the intaglio printing unit comprises an impression cylinder for transporting the sheet, and an intaglio printing cylinder, provided below the impression cylinder, for performing printing on the sheet being transported.

A third aspect of the present invention is directed to the sheet-fed printing press according to the second aspect, wherein the stencil printing cylinder is a rotary screen.

A fourth aspect of the present invention is directed to the sheet-fed printing press according to the second aspect, wherein the intaglio printing cylinder is a gravure plate cylinder.

A fifth aspect of the present invention is directed to the sheet-fed printing press according to the first aspect, wherein the reversing device is equipped with a reversing cylinder which accepts and grips a rear end of the sheet transported from the first printing unit, with a leading end of the sheet being held, thereby reversing the sheet, or which accepts and grips the leading end of the sheet transported from the first printing unit, with the leading end of the sheet being held, thereby not reversing the sheet.

A sixth aspect of the present invention is directed to the sheet-fed printing press according to the fifth aspect, further comprising a transport cylinder which opposes the reversing cylinder on a side upstream of the reversing cylinder in the sheet transport direction to hold the leading end of the sheet transported from the first printing unit.

A seventh aspect of the present invention is directed to the sheet-fed printing press according to the sixth aspect, wherein the transport cylinder is an attraction cylinder.

An eighth aspect of the present invention is directed to the sheet-fed printing press according to the sixth aspect, wherein the drying device opposes the transport cylinder.

A ninth aspect of the present invention is directed to the sheet-fed printing press according to the first aspect, wherein the stencil printing unit performs screen printing.

A tenth aspect of the present invention is directed to the sheet-fed printing press according to the first aspect, wherein the intaglio printing unit performs gravure printing.

According to the sheet-fed printing press of the present invention, printing on the sheet by intaglio printing and stencil printing can be performed in one pass on one surface of the sheet (single-sided printing) and/or on both of the one surface and the other surface of the sheet (double-sided printing).

Consequently, an operator need not perform a reversing operation for or registration of the sheet between the intaglio printing unit and the stencil printing unit. Thus, the operating efficiency can be improved.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A sheet-fed printing press according to the present invention will be described in detail by embodiments with reference to the accompanying drawings. In each embodiment, members having the same structures and functions are assigned the same numerals, and their explanations will be omitted in a later embodiment.

Embodiment 1

Figure 1:
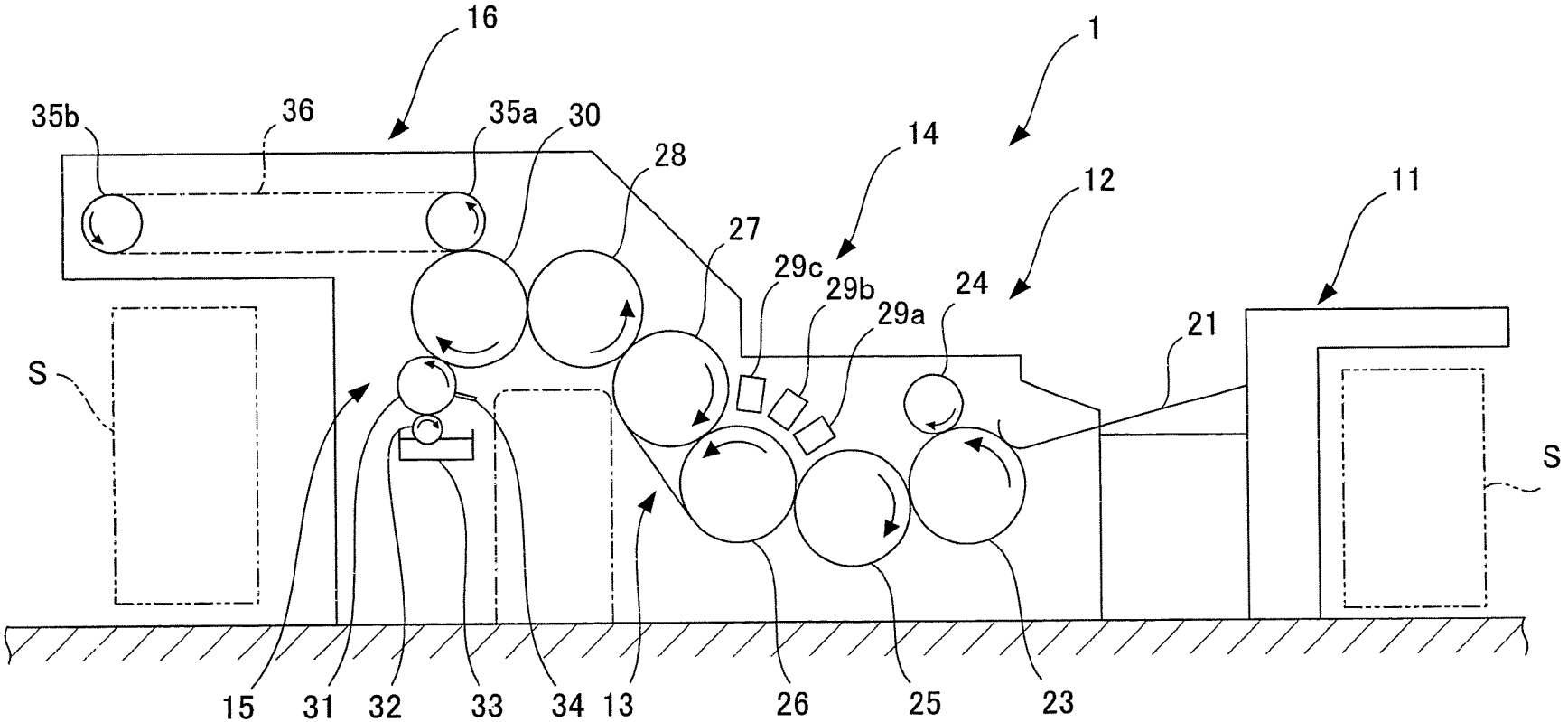
FIG. 1 is a schematic view of a sheet-fed printing press according to a first embodiment of the present invention.

FIG. 1 is a schematic view of a sheet-fed printing press according to a first embodiment of the present invention.

As shown in FIG. 1, a sheet-fed printing press 1 is equipped with a feeder 11, a screen printing unit (a first printing unit, a stencil printing unit) 12, a drying unit 14, a reversing unit 13, a gravure printing unit (a second printing unit, an intaglio printing unit) 15, and a delivery unit 16. A sheet (a sheet) S passes through these devices sequentially, and is thereby printed on.

The feeder 11 is provided with a sheet feeding plate 21, and feeds the sheets S, one by one, from the sheet feeding plate 21 to the screen printing unit 12 via a swing arm shaft pregripper (not shown) provided at the leading end of the sheet feeding plate 21.

The screen printing unit 12 is provided with an impression cylinder 23 which receives the sheet S fed from the sheet feeding plate 21 via the swing arm shaft pregripper. A rotary screen (stencil printing cylinder) 24 in contact with the impression cylinder 23 is provided downstream of the sheet feeding plate 21 in the rotating direction of the impression cylinder 23. That is, the point of contact between the impression cylinder 23 and the rotary screen 24 serves as the point of screen printing. A transfer cylinder 25 in contact with the impression cylinder 23 is provided downstream of the rotary screen 24 in the rotating direction of the impression cylinder 23.

The rotary screen 24 is composed of a hollow cylinder which is a thin screen (comprising stainless steel, nickel or the like) etched with small holes corresponding to a pattern and rotatably supported in a cylindrical form, and an ink fountain and a squeegee fixed to and supported by a frame within the hollow cylinder. That is, the hollow cylinder rotates in accordance with the rotation of the impression cylinder 23, and ink within the ink fountain is pushed out through the small holes of the hollow cylinder by the squeegee, whereby the rotary screen 24 can perform printing, which corresponds to the small holes of the hollow cylinder, on the sheet S held by the impression cylinder 23. Thus, the screen printing unit 12, which is composed of the impression cylinder 23 and the rotary screen 24 located above and contacting the impression cylinder 23, applies printing to one surface of the sheet S. The one surface of the sheet S refers to the first surface to be printed by the printing press. The other surface of the sheet S refers to the surface on the side opposite to the one surface of the sheet S.

The drying unit 14 is provided with UV lamps 29*a*, 29*b*, and 29*c* which oppose the upper peripheral surface of an attraction cylinder 26 in contact with the transfer cylinder 25, and which are arranged in parallel. That is, the UV lamps 29*a*, 29*b*, and 29*c* throw ultraviolet rays from above the attraction cylinder 26 toward the upper peripheral surface of the attraction cylinder 26 to dry the ink on the one surface of the sheet S attracted to the attraction cylinder 26.

The reversing unit 13 is provided with the attraction cylinder (transport cylinder) 26 in contact with the transfer cylinder 25, as mentioned above. A reversing cylinder 27 in contact with the attraction cylinder 26 is provided downstream of the transfer cylinder 25 in the rotating direction of the attraction cylinder 26. A transfer cylinder 28 in contact with the reversing cylinder 27 is provided downstream of the attraction cylinder 26 in the rotating direction of the reversing cylinder 27.

In the reversing unit 13, during single-sided printing, a rear end portion of the one surface of the sheet S sucked by the attraction cylinder 26 is once held by a holding member of the reversing cylinder 27 at a site in the vicinity of the point of contact between the attraction cylinder 26 and the reversing cylinder 27. With the sheet S being passed from the attraction cylinder 26 on to the reversing cylinder 27, the rear end portion of the sheet S is similarly passed from the holding member on to and gripped by a gripper of a gripper device of the reversing cylinder 27. By this action, the sheet S is reversed by the reversing unit 13, and transported such that the one surface of the sheet S is pointed outward on the reversing cylinder 27. Then, the sheet S is supplied to the gravure printing unit 15 via the transfer cylinder 28.

During double-sided printing, on the other hand, a leading end portion of the one surface of the sheet S sucked by the attraction cylinder 26 is directly accepted and gripped by the gripper of the gripper device of the reversing cylinder 27 at a site in the vicinity of the point of contact between the attraction cylinder 26 and the reversing cylinder 27. By this action, the sheet S is not reversed by the reversing unit 13, but is transported such that the other surface of the sheet S is pointed outward on the reversing cylinder 27. Then, the sheet S is supplied to the gravure printing unit 15 via the transfer cylinder 28. Since a reversing mechanism in the reversing unit 13 has already been known publicly, a detailed description of its structure is omitted herein.

In the gravure printing unit 15, an impression cylinder 30 in contact with the transfer cylinder 28 is provided. A gravure plate cylinder (intaglio printing cylinder) 31 in contact with the impression cylinder 30 is provided downstream of the transfer cylinder 28 in the rotating direction of the impression cylinder 30. That is, the point of contact between the impression cylinder 30 and the gravure plate cylinder 31 serves as the point of gravure printing. An ink roller 32 in contact with the gravure plate cylinder 31 is provided downstream of the impression cylinder 30 in the rotating direction of the gravure plate cylinder 31. A lower side of the ink roller 32 is immersed in an ink reservoir 33 where ink is stored inside. A doctor 34 in contact with the gravure plate cylinder 31 is provided downstream of the ink roller 32 in the rotating direction of the gravure plate cylinder 31 and upstream of the impression cylinder 30 in the rotating direction of the gravure plate cylinder 31. The doctor 34 removes surplus ink deposited on non-image areas of the gravure plate cylinder 31. Thus, the gravure printing unit 15, which is composed of the impression cylinder 30, the gravure plate cylinder 31 located below the impression cylinder 30 and contacting the impression cylinder 30, the ink roller 32, and the ink reservoir 33, applies printing to the other surface of the sheet S.

In the delivery unit 16, sprockets 35*a* and 35*b*, one of which contacts the impression cylinder 30, are provided, and a delivery chain 36 is looped between the sprockets 35*a* and 35*b*. A plurality of gripper bars (not shown) for receiving the sheet S from the impression cylinder 30 are mounted on the delivery chain 36 at predetermined intervals along the travel direction of the delivery chain 36. Upon travel of the delivery chain 36, the sheet S is delivered downwardly of the delivery chain 36.

Because of the above-described features, when single-sided printing is performed, the sheet S fed to the sheet feeding plate 21 is passed on to the impression cylinder 23 via the swing arm shaft pregripper. Then, the sheet S accepted by the impression cylinder 23 is supplied between the impression cylinder 23 and the rotary screen 24. At this site, the ink pushed out through the small holes of the hollow cylinder is transferred to the sheet S, whereby screen printing is done on one surface of the sheet S. The sheet S subjected to screen printing is passed on to the attraction cylinder 26 via the transfer cylinder 25, and has the one surface dried by irradiation from the UV lamps 29*a*, 29*b*, and 29*c*. Then, the dried sheet S is supplied between the attraction cylinder 26 and the reversing cylinder 27, and reversed by the reversing unit 13. As a result, the reversed sheet S is transported, with the one surface thereof being pointed outward on the reversing cylinder 27. Then, the sheet S is passed on to the impression cylinder 30 via the transfer cylinder 28.

The sheet S accepted by the impression cylinder 30 is supplied between the impression cylinder 30 and the gravure plate cylinder 31. At this time, the ink is supplied from the ink reservoir 33 to the gravure plate cylinder 31 via the ink roller 32, and surplus ink adhering to the non-image areas of the gravure plate cylinder 31 is removed by the doctor 34. Then, the ink is transferred from recessed image areas, which are lower in height than the non-image areas of the gravure plate cylinder 31, to the one surface of the sheet S held by the impression cylinder 30, whereby gravure printing is done. Then, the sheet S subjected to gravure printing is passed on to the delivery chain 36, and then delivered.

When double-sided printing is performed, the sheet S supplied between the attraction cylinder 26 and the reversing cylinder 27 is not reversed in the reversing unit 13. That is, the sheet S is not reversed by the reversing unit 13, but is transported, with the other surface thereof being pointed outward on the reversing cylinder 27, and is then passed on to the impression cylinder 30 via the transfer cylinder 28.

The sheet S accepted by the impression cylinder 30 is supplied between the impression cylinder 30 and the gravure plate cylinder 31. At this time, the ink is supplied from the ink reservoir 33 to the gravure plate cylinder 31 via the ink roller 32, and surplus ink adhering to the non-image areas of the gravure plate cylinder 31 is removed by the doctor 34. Then, the ink is transferred from the recessed image areas, which are lower in height than the non-image areas of the gravure plate cylinder 31, to the other surface of the sheet S held by the impression cylinder 30, whereby gravure printing is done. Then, the sheet S subjected to gravure printing is passed on to the delivery chain 36, and then delivered.

The sheet-fed printing press according to the present invention, therefore, can print the one surface of the sheet S (single-sided printing) and/or both of the one surface and the other surface of the sheet S (double-sided printing) in one pass when performing printing on the sheet S by screen printing and gravure printing. Consequently, an operator need not perform a reversing operation for or registration of the sheet S between the screen printing unit 12 and the gravure printing unit 15. Thus, the operating efficiency can be improved. Moreover, the screen printing unit 12 and the gravure printing unit 15 can be combined, so that a saving in the space required for the machines can be achieved.

Embodiment 2

Figure 2:
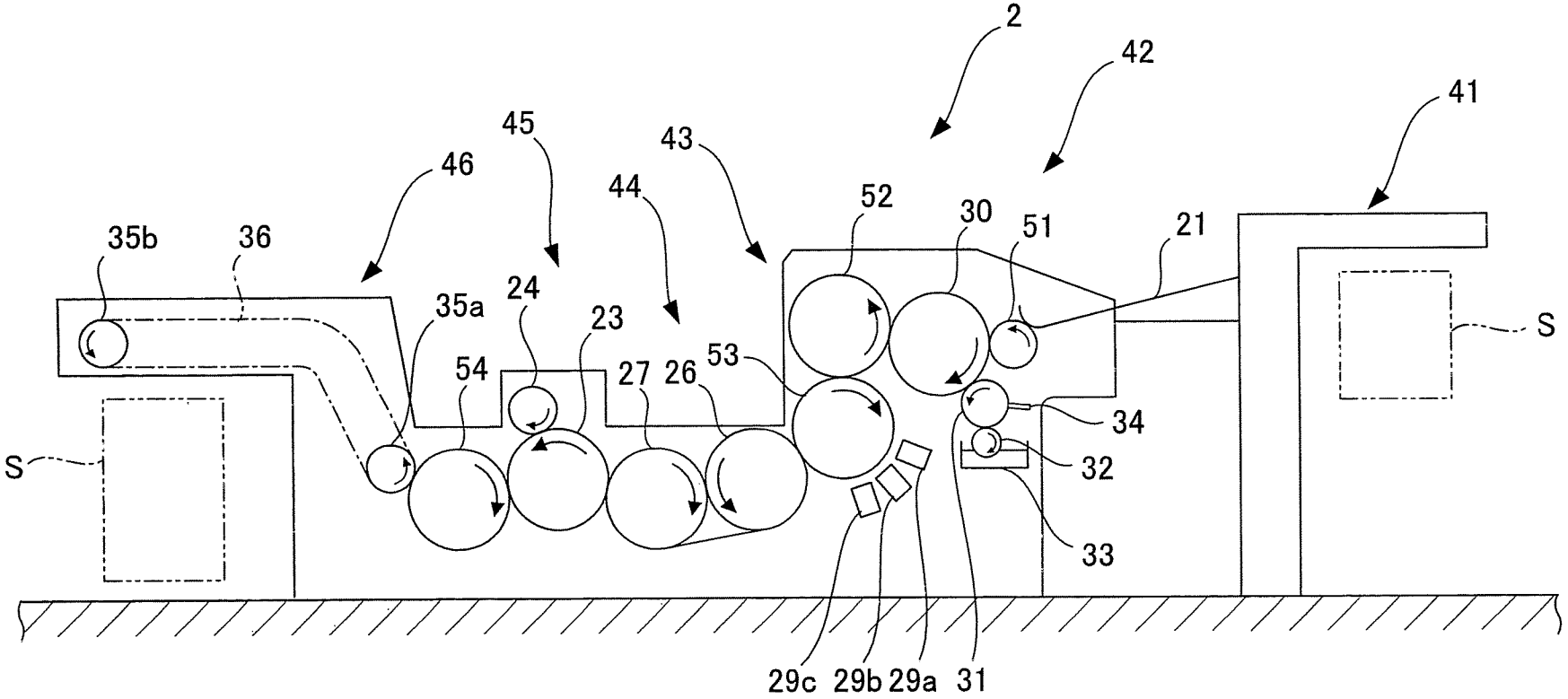
FIG. 2 is a schematic view of a sheet-fed printing press according to a second embodiment of the present invention.

FIG. 2 is a schematic view of a sheet-fed printing press according to a second embodiment of the present invention.

As shown in FIG. 2, a sheet-fed printing press 2 is equipped with a feeder 41, a gravure printing unit (a first printing unit, an intaglio printing unit) 42, a drying unit 43, a reversing unit 44, a screen printing unit (a second printing unit, a stencil printing unit) 45, and a delivery unit 46. A sheet (a sheet) S passes through these devices sequentially, and is thereby printed on.

The feeder 41 is provided with a sheet feeding plate 21, and feeds the sheets S, one by one, from the sheet feeding plate 21 to the gravure printing unit 42 via a swing arm shaft pregripper (not shown) and a transfer cylinder 51 provided at the leading end of the sheet feeding plate 21.

The gravure printing unit 42 is provided with an impression cylinder 30 which receives the sheet S fed from the sheet feeding plate 21 via the swing arm shaft pregripper and the transfer cylinder 51. The gravure printing unit 42 is composed of the above-mentioned impression cylinder 30, a gravure plate cylinder 31, an ink roller 32, an ink reservoir 33, and a doctor 34. A transfer cylinder 52 in contact with the impression cylinder 30 is provided downstream of the gravure plate cylinder 31 in the rotating direction of the impression cylinder 30.

The drying unit 43 is provided with a transfer cylinder 53, which contacts the transfer cylinder 52 downstream of the impression cylinder 30 in the rotating direction of the transfer cylinder 52, and UV lamps 29*a*, 29*b*, and 29*c* which are arranged in parallel so as to oppose the lower peripheral surface of the transfer cylinder 53. That is, the UV lamps 29*a*, 29*b*, and 29*c* throw ultraviolet rays from below the transfer cylinder 53 toward the lower peripheral surface of the transfer cylinder 53 to dry ink on one surface of the sheet S gripped by the transfer cylinder 53.

The reversing unit 44 is provided with an attraction cylinder 26 in contact with the transfer cylinder 53, and a reversing cylinder 27 in contact with the attraction cylinder 26.

The screen printing unit 45 is provided with an impression cylinder 23 in contact with the reversing cylinder 27, and a rotary screen 24 in contact with the impression cylinder 23. A transfer cylinder 54 in contact with the impression cylinder 23 is provided downstream of the rotary screen 24 in the rotating direction of the impression cylinder 23.

In the delivery unit 46, sprockets 35*a* and 35*b*, one of which contacts the transfer cylinder 54, are provided, and a delivery chain 36 is looped between the sprockets 35*a* and 35*b*.

Because of the above-described features, therefore, when single-sided printing is performed, the sheet S fed to the sheet feeding plate 21 is passed on to the transfer cylinder 51 via the swing arm shaft pregripper. Then, the sheet S accepted by the transfer cylinder 51 is passed on to the impression cylinder 30, and then supplied between the impression cylinder 30 and the gravure plate cylinder 31. At this time, ink is supplied from the ink reservoir 33 to the gravure plate cylinder 31 via the ink roller 32, and surplus ink adhering to non-image areas of the gravure plate cylinder 31 is removed by the doctor 34.

Then, the ink is transferred from recessed image areas, which are lower in height than the non-image areas of the gravure plate cylinder 31, to the one surface of the sheet S held by the impression cylinder 30, whereby gravure printing is done.

Then, the sheet S subjected to gravure printing is passed on to the transfer cylinder 53 via the transfer cylinder 52, and has the one surface dried by irradiation from the UV lamps 29*a*, 29*b*, and 29*c*. Then, the dried sheet S is supplied between the attraction cylinder 26 and the reversing cylinder 27, and reversed by the reversing unit 44. As a result, the reversed sheet S is transported, with the other surface thereof being pointed outward on the reversing cylinder 27. Then, the sheet S is passed on to the impression cylinder 23. The sheet S accepted by the impression cylinder 23 is supplied between the impression cylinder 23 and the rotary screen 24. At this site, ink pushed out through the small holes of the hollow cylinder is transferred to the sheet S, whereby screen printing is done on the one surface of the sheet S. Then, the sheet S subjected to screen printing is passed on to the delivery chain 36, and then delivered.

When double-sided printing is performed, on the other hand, the sheet S supplied between the attraction cylinder 26 and the reversing cylinder 27 is not reversed in the reversing unit 44. That is, the sheet S is not reversed by the reversing unit 44, but is transported, with the one surface thereof being pointed outward on the reversing cylinder 27, and is then passed on to the impression cylinder 23. The sheet S accepted by the impression cylinder 23 is supplied between the impression cylinder 23 and the rotary screen 24. At this site, the ink pushed out through the small holes of the hollow cylinder is transferred to the sheet S, whereby screen printing is done on the other surface of the sheet S. Then, the sheet S subjected to screen printing is passed on to the delivery chain 36, and then delivered.

The sheet-fed printing press according to the present invention, therefore, can print the one surface of the sheet S (single-sided printing) and/or both of the one surface and the other surface of the sheet S (double-sided printing) in one pass when performing printing on the sheet S by gravure printing and screen printing. Consequently, an operator need not perform a reversing operation for or registration of the sheet S between the gravure printing unit 42 and the screen printing unit 45. Thus, the operating efficiency can be improved. Moreover, the gravure printing unit 42 and the screen printing unit 45 can be combined, so that a saving in the space required for the machines can be achieved.

The present invention, as described above, can be applied to a combined sheet-fed printing press for performing intaglio printing and stencil printing on a sheet.

The invention thus described, it will be obvious that the same may be varied in many ways. In the above-described embodiments, gravure printing is disclosed as an example of intaglio printing, but engraved intaglio printing may be used. Also, screen printing is disclosed as an example of stencil printing, but mimeographing may be used. Furthermore, the attraction cylinder is disclosed as the transport cylinder which opposes the reversing cylinder on the side upstream of the reversing cylinder in the transport direction of the sheet to hold the leading end of the sheet transported from the first printing unit. However, the transport cylinder may be an impression cylinder or a transfer cylinder. Such variations are not to be regarded as a departure from the spirit and scope of the invention, and all such modifications as would be obvious to one skilled in the art are intended to be included within the scope of the following claims.

What is claimed is:

1. A sheet-fed printing press, comprising:

a first printing unit for printing one surface of a sheet being transported;

a drying device, provided downstream of the first printing unit in a sheet transport direction, for drying the one surface of the sheet printed by the first printing unit;

a second printing unit, provided downstream of the drying device in the sheet transport direction, for performing printing on the sheet dried by the drying device; and a reversing device, provided between the drying device and the second printing unit, for switching between double-sided printing in which the sheet is transported to the second printing unit so that the other surface of the sheet on a side opposite to the one surface of the sheet printed by the first printing unit is printed by the second printing unit, and single-sided printing in which the sheet is transported to the second printing unit after reversing the sheet so that the one surface of the reversed sheet is printed by the second printing unit, and wherein the first printing unit is one of a stencil printing unit and an intaglio printing unit, and the second printing unit is the other of the stencil printing unit and the intaglio printing unit, wherein the stencil printing unit comprises a first impression cylinder for transporting the sheet, and a stencil printing cylinder for performing printing on the sheet being transported, and the intaglio printing unit comprises a second impression cylinder for transporting the sheet, and an intaglio printing cylinder for performing printing on the sheet being transported, and wherein the reversing device is equipped with a reversing cylinder, provided between the first and second impression cylinders, which accepts and grips a rear end of the sheet transported from the first printing unit, with a leading end of the sheet being held, thereby reversing the sheet, or which accepts and grips the leading end of the sheet transported from the first printing unit, with the leading end of the sheet being held, thereby not reversing the sheet, wherein the stencil printing cylinder is a rotary screen, and wherein the sheet-fed printing press is configured to print valuables including at least one of bills, stock certificates, and stamps.

2. The sheet-fed printing press according to claim 1, wherein the intaglio printing cylinder is a gravure plate cylinder.

3. The sheet-fed printing press according to claim 1, further comprising:

a plurality of transport cylinders that includes a transport cylinder which opposes the reversing cylinder on a side upstream of the reversing cylinder in the sheet transport direction to hold the leading end of the sheet transported from the first printing unit.

4. The sheet-fed printing press according to claim 3, wherein the transport cylinder is an attraction cylinder.

5. The sheet-fed printing press according to claim 3, wherein the drying device opposes the transport cylinder.

6. The sheet-fed printing press according to claim 1, wherein the stencil printing unit performs screen printing.

7. The sheet-fed printing press according to claim 1, wherein the intaglio printing unit performs gravure printing.

8. A sheet-fed printing press, comprising:

a first printing unit for printing one surface of a sheet being transported;

a drying device, provided downstream of the first printing unit in a sheet transport direction, for drying the one surface of the sheet printed by the first printing unit;

a second printing unit, provided downstream of the drying device in the sheet transport direction, for performing printing on the sheet dried by the drying device; and a reversing device, provided between the drying device and the second printing unit, for switching between double-sided printing in which the other surface of the sheet on a side opposite to the one surface of the sheet printed by the first printing unit is printed by the second printing unit, and single-sided printing in which the sheet printed on by the first printing unit is reversed, and the one surface of the reversed sheet is printed by the second printing unit, and wherein the first printing unit is one of a stencil printing unit and an intaglio printing unit, and the second printing unit is the other of the stencil printing unit and the intaglio printing unit, and the reversing device is provided between the drying device and the second printing unit without the drying device overlapping the reversing device in a transporting direction of the sheet, wherein the stencil printing unit comprises a first impression cylinder for transporting the sheet, and a stencil printing cylinder for performing printing on the sheet being transported, and the intaglio printing unit comprises a second impression cylinder for transporting the sheet, and an intaglio printing cylinder for performing printing on the sheet being transported, and wherein the reversing device is equipped with a reversing cylinder, provided between the first and second impression cylinders, which accepts and grips a rear end of the sheet transported from the first printing unit, with a leading end of the sheet being held, thereby reversing the sheet, or which accepts and grips the leading end of the sheet transported from the first printing unit, with the leading end of the sheet being held, thereby not reversing the sheet, wherein the stencil printing cylinder is a rotary screen, and wherein the sheet-fed printing press is configured to print valuables including at least one of bills, stock certificates, and stamps.

9. The sheet-fed printing press according to claim 1, further comprising:

at least three transport cylinders.

10. The sheet-fed printing press according to claim 8, further comprising:

at least three transport cylinders.

11. A sheet-fed printing press, comprising:

a first printing unit for printing one surface of a sheet being transported;

a drying device, provided downstream of the first printing unit in a sheet transport direction, for drying the one surface of the sheet printed by the first printing unit;

a second printing unit, provided downstream of the drying device in the sheet transport direction, for performing printing on the sheet dried by the drying device; and a reversing device, provided between the drying device and the second printing unit, for switching between double-sided printing in which the sheet is transported to the second printing unit without reversing the sheet so that the other surface of the sheet on a side opposite to the one surface of the sheet printed by the first printing unit is printed by the second printing unit, and single-sided printing in which the sheet is transported to the second printing unit so that the one surface of the reversed sheet is printed by the second printing unit, and wherein the first printing unit is one of a stencil printing unit and an intaglio printing unit, and the second printing unit is the other of the stencil printing unit and the intaglio printing unit, wherein the stencil printing unit comprises a first impression cylinder for transporting the sheet, and a stencil printing cylinder for performing printing on the sheet being transported, and the intaglio printing unit comprises a second impression cylinder for transporting the sheet, and an intaglio printing cylinder for performing printing on the sheet being transported, and wherein the reversing device is equipped with a reversing cylinder, provided between the first and second impression cylinders, which accepts and grips a rear end of the sheet transported from the first printing unit, with a leading end of the sheet being held, thereby reversing the sheet, or which accepts and grips the leading end of the sheet transported from the first printing unit, with the leading end of the sheet being held, thereby not reversing the sheet, wherein the stencil printing cylinder is a rotary screen, and wherein the sheet-fed printing press is configured to print valuables including at least one of bills, stock certificates, and stamps.

* * * * *